US005503381A

United States Patent [19]

Weber et al.

[11] Patent Number: 5,503,381

[45] Date of Patent: Apr. 2, 1996

[54] SORTING APPARATUS FOR SHEET-LIKE ARTICLES

[75] Inventors: Bruno Weber, Hettenshausen, Germany; Albert van der Meer, Samstagern; Thomas Rutishauser, Uerikon, both of Switzerland

[73] Assignee: Rutishauser GmbH, Pfaffenhofen, Germany

[21] Appl. No.: 296,011

[22] Filed: Aug. 15, 1994

[30] Foreign Application Priority Data

Aug. 17, 1993 [CH] Switzerland ..... 02448/93

[51] Int. Cl.[6] ..... B65H 39/02; B65H 39/10

[52] U.S. Cl. ..... 270/58; 271/303

[58] Field of Search ..... 270/58; 271/288, 271/303, 287

[56] References Cited

U.S. PATENT DOCUMENTS

| | | | |
|---|---|---|---|
| 4,822,016 | 4/1989 | Sakuuchi et al. | 270/58 |
| 4,890,826 | 1/1990 | Rutishauser | 271/303 X |
| 5,131,644 | 7/1992 | DuBois | 271/303 X |
| 5,293,698 | 3/1994 | Petersen | 270/58 X |

FOREIGN PATENT DOCUMENTS

| | | | |
|---|---|---|---|
| 511528 | 11/1992 | European Pat. Off. | 271/287 |
| 3708157 | 2/1988 | Germany . | |
| 61-254460 | 11/1986 | Japan | 271/303 |
| 1-36472 | 2/1989 | Japan | 271/303 |
| 1-172172 | 7/1989 | Japan | 271/303 |
| 4-129961 | 4/1992 | Japan | 271/303 |

OTHER PUBLICATIONS

IBM Technical Disclosure Bulletin, J. M. Bevil and J. Florence, vol. 19 No. 7, Dec. 1976, p. 2442.

Xerox Disclosure Journal, Indexing Mechanism for fan--type sorter, Jan Lap, vol. 10 No. 5 Sep./Oct. 1985 p. 277.

*Primary Examiner*—John E. Ryznic

*Attorney, Agent, or Firm*—Cushman, Darby & Cushman

[57] ABSTRACT

A feeding device 2 is arranged upstream of a distributing device 20 and comprises a sheet duct, and a pair of clamping rollers 10, 12 arranged at the outlet end 8 of the latter. The distributing device comprises an individual path 80" for each of a multiplicity of delivery points 70". Each path is delimited by flexible bands 56. On the side directed against the feeding device each of the bands is connected to a compartment-forming member 58 of a receiving compartment 82 and on the opposite side to a deflecting member 84. The receiving compartments form a unit 22, which may be swivelled relative to the feeding device. Transport rolls 64, which are disposed along the bands, are common to all pathes and are movable transversely to the path direction.

10 Claims, 6 Drawing Sheets

SORTING APPARATUS FOR SHEET-LIKE ARTICLES

BACKGROUND OF THE INVENTION

The invention relates to a sorting apparatus for sorting sheet like articles.

Sorting apparatuses of this type for printed or copied sheets are known. In these apparatus, starting from a fixed delivery path, which may belong to a printer or copier, the sheets are transferred to the feeding device, which directs them to the distributing device. The deflecting members of the distributing device are designed as pivotable flaps and for each of the same there is provided an electromagnet as actuating means, in order to deflect the recording media out of the transporting route, shared up to the respective deflecting member, into a depositing compartment.

Since, in the deflecting position, the flaps block the transporting route to the respectively following depositing compartments, the actuation of a next flap with respect to a preceding depositing compartment must not take place as long as the preceding sheet is still in the corresponding region of the transporting route. Each depositing compartment is therefore assigned a sensor, for example a photocell responding to the passage of the rear edge of a sheet, in order to establish the respective actual conditions during the transport of a sheet and, in interaction with a computing control device, to actuate the flaps with correspondingly coordinated timing. In spite of this outlay, the statistical reliability of such sorting apparatuses is unsatisfactory.

It is likewise disadvantageous in the case of these known apparatuses that the actuation of the flaps necessary locally in each case requires electric motors or electromagnets in corresponding number and also corresponding wiring for the distributed current conduction. Apart from the costs, this has as a consequence undesired interfering electromagnetic radiations.

SUMMARY OF THE INVENTION

The object of the invention is to provide a sorting apparatus which, by reducing the number of parts moved in a controlled manner independently of one another, allows high reliability to be achieved at the same time as little control outlay and correspondingly low production costs.

This object is achieved according to the invention by the features of FIG. 1.

With the sorting apparatus according to the invention, not only recording media in sheet form, but also stiff and only scarcely flexible sheet-like articles can be transported and handled in a sorting manner. Thus, in particular articles enclosed by envelopes or packages and having contents which differ with respect to stiffness can be sorted.

The way in which this is achieved according to the invention combines the parts requiring control for the sorting operation in such a way that a number, corresponding to the number of addresses, of parts movable in a controlled manner independently of one another, and also their actuating members are unnecessary. The actuations necessary for the sorting operation are reduced to at most two, in order to establish the assignment between feeding device and a particular compartment of the receiving-compartment unit. Once entry of the recording media into a receiving compartment corresponding to an address has taken place, the actual sorting operation is completed in at least one first stage. If the apparatus comprises only a single-stage sorting, further transport to the chosen deposit is ensured without further control outlay, thanks to the unequivocally individualized path to the said deposit. Finally, the transfer into the deposit from the directionally shared part of the transporting route takes place by the mere presence of the respective deflecting member.

In the case of sorting in a plurality of stages following one another, the above statements apply analogously for each of the said stages.

Since the number of transporting parts corresponds at least to the number of addresses to be served, in principle it is possible to transport a plurality of sheets arriving in a phase-shifted sequence to the addresses of a sorting stage simultaneously with the or each distributing device according to the invention. The sorting rate is consequently independent of the length of the transporting paths or the number and sheet capacity of downstream depositing compartments.

According to a preferred embodiment of the invention, for the delimitation of in each case two neighboring paths, there are provided a plurality of directing members running parallel to one another, which are configured in strip form and flexurally elastic, at least one of the same being electrically conductively designed and grounded.

Am advantageous configuration of the sorting apparatus according to the invention is that of the multistage, cascade-like interconnection, such that each of the delivery points of a first distributing device or a first sorting stage forms the feeding device of a following distributing device or a further stage. This allows sorting to a number of delivery point which amounts to a multiple of the delivery points possible at most in practice in a single distributing device or stage.

BRIEF DESCRIPTION OF THE DRAWINGS

The sorting apparatus according to the invention, in two embodiments of a single-stage design of sorting units comprising depositing compartments, is explained in more detail below with reference to the drawing, in which.

DETAILED DESCRIPTION OF THE PRESENTLY PREFERRED EXEMPLARY EMBODIMENT

Figure 2:
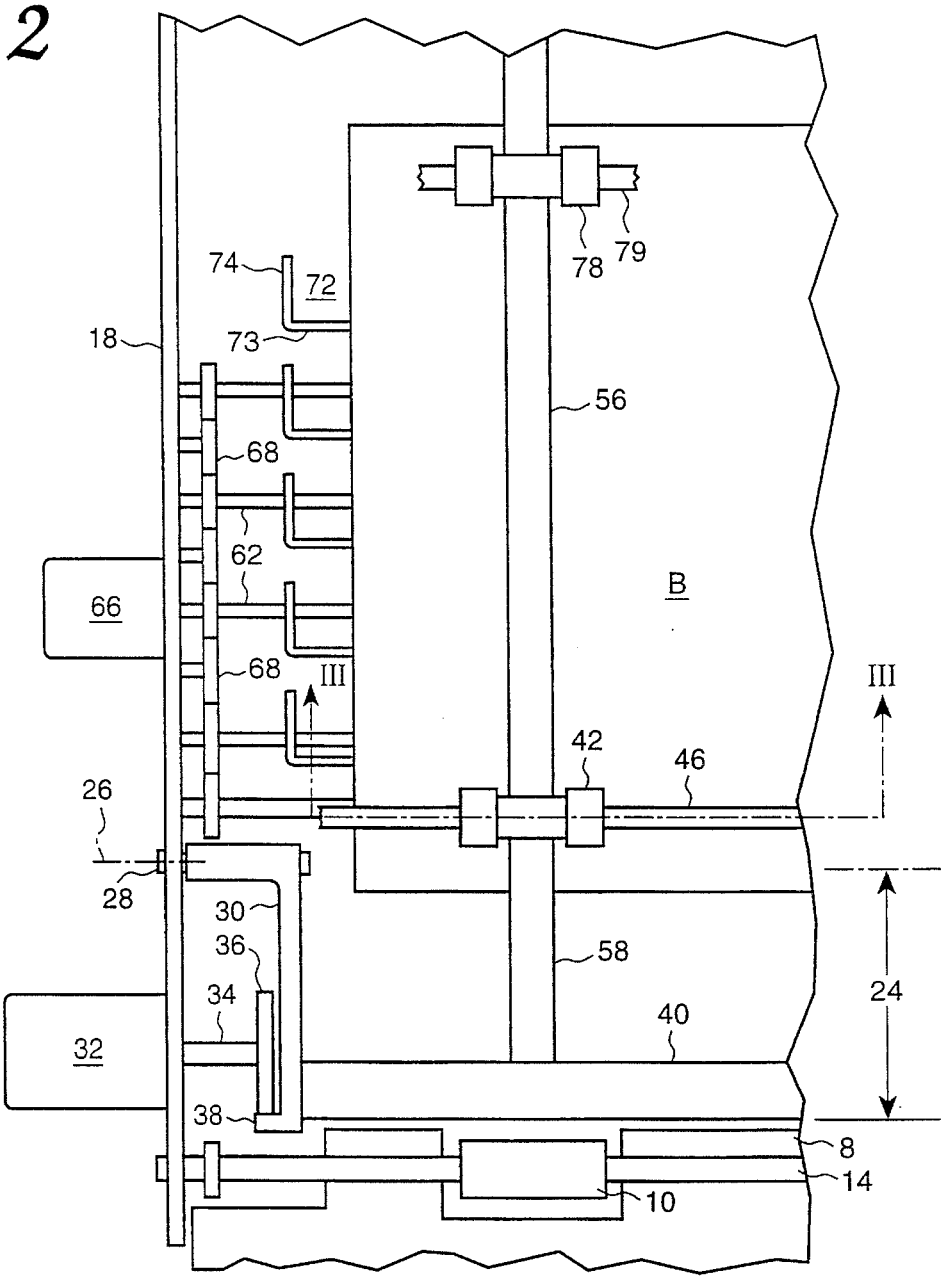
FIG. 2 shows a section through the sorting unit along line II—II in FIG. 1.

The sorting unit according to the first exemplary embodiment has a feeding device 2, with a stationary sheet duct 4 of a curved design, which at its inlet end 6 is of a funnel-shaped design and to the outwardly directed outlet end 8 of which a pair of clamping rollers 10, 12 are assigned. A shaft 14, carrying the clamping roller 12, is driven in a way still to be explained in more detail. Two sideplates 18, rigidly connected to each other, of which only the one on the left-hand side in FIG. 2 is shown, serve for supporting the sheet duct 4 on both sides and rotatably receive the ends of the shafts 14 carrying the clamping rollers 10, 12. The sheet duct 4 is assigned a sensor 7 at its inlet end 6.

A distributing device 20, arranged downstream of the feeding device, comprises a swivelling unit 22, which is arranged between the sideplates 18 and can be swivelled about an axis 26 spaced away from the outlet end 8 of the sheet duct 4 by the radius 24. The two end positions of the swivelling unit 22 are indicated by the outlines **22*a* and 22*b*, respectively, shown as dashed lines. The axis 26, which lies in an imaginary mid-plane of the upwardly directed outlet end 8 of the sheet duct 4, is formed by a journal 28 of each of two swivel plates 30, arranged lying opposite each other, of which only the one on the left-hand side in FIG. 2 is shown. The swivel plates 30, which have the form of segments of a circle, are rigidly connected to each other in a way not shown. To simplify the representation, an electric motor 32, fastened on the left-hand sideplate 18, is shown as carrying on its shaft 34 a pinion 36, which meshes directly with a toothed rim 38 on the swivel plate 30. The electric motor 32, acting as an actuating member for the swivelling unit 22 of the distributing device 20, is controllable in a positionally accurate manner in a known way with respect to its rotational position and is expediently in drive connection with the toothed rim via a step-down gear mechanism (not shown). A multiplicity of securing means, arranged such that they are distributed on an arc of a circle, extend in a direction of extent parallel to the axis 26 between the swivel plates 30. The securing means are formed by U-shaped profile elements 40, which are narrow and thin-walled. Arranged in a rotationally rigid manner directly above the swivelling unit 22, or its axis 26, is a pair of clamping rollers 42, 44 on shafts 46, the shafts being mounted rotatably in the sideplates 18. The distance, including the radius 24, between the clamping rollers 42, 44 and the clamping rollers 10, 12** is less than a predetermined minimum extent of a sheet to be transported in the transporting direction.

Figure 3:
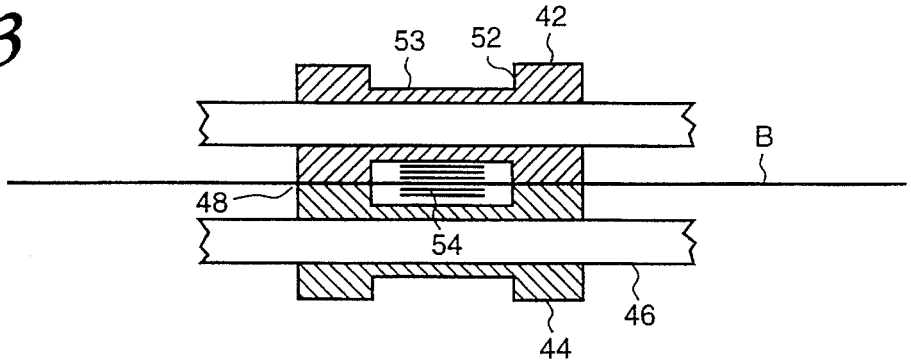
FIG. 3 shows on an enlarged scale a section along line III—III in FIG. 2.

As can be seen from FIG. 3, the clamping rollers 42, 44 are provided with grooves 52 with a cylindrical base 53. Between the clamping rollers 42, 44 and through their grooves 52 extends a group of bands 54, comprising a multiplicity of bands 56, with clearance, both in the width and in the depth of the grooves. The bands 56 are resiliently flexible and, at least on their surfaces, electrically conductive; in the exemplary embodiment shown, they consist of steel, The bands 56 extend with lower end parts 58 in the swivelling unit 22. In the U-shaped profile elements 40, which are open toward the axis 26, there is rigidly fastened in each case an end part 58, for example by clamping. Starting from the clamping rollers 42, 44, against the cylindrical base 53 of which the respectively outermost bands 56 of the group 54 bear, the band parts 58 undergo a spreading apart, in the direction of the profile elements, which corresponds to their spacing on the arc of a circle.

Figure 1:
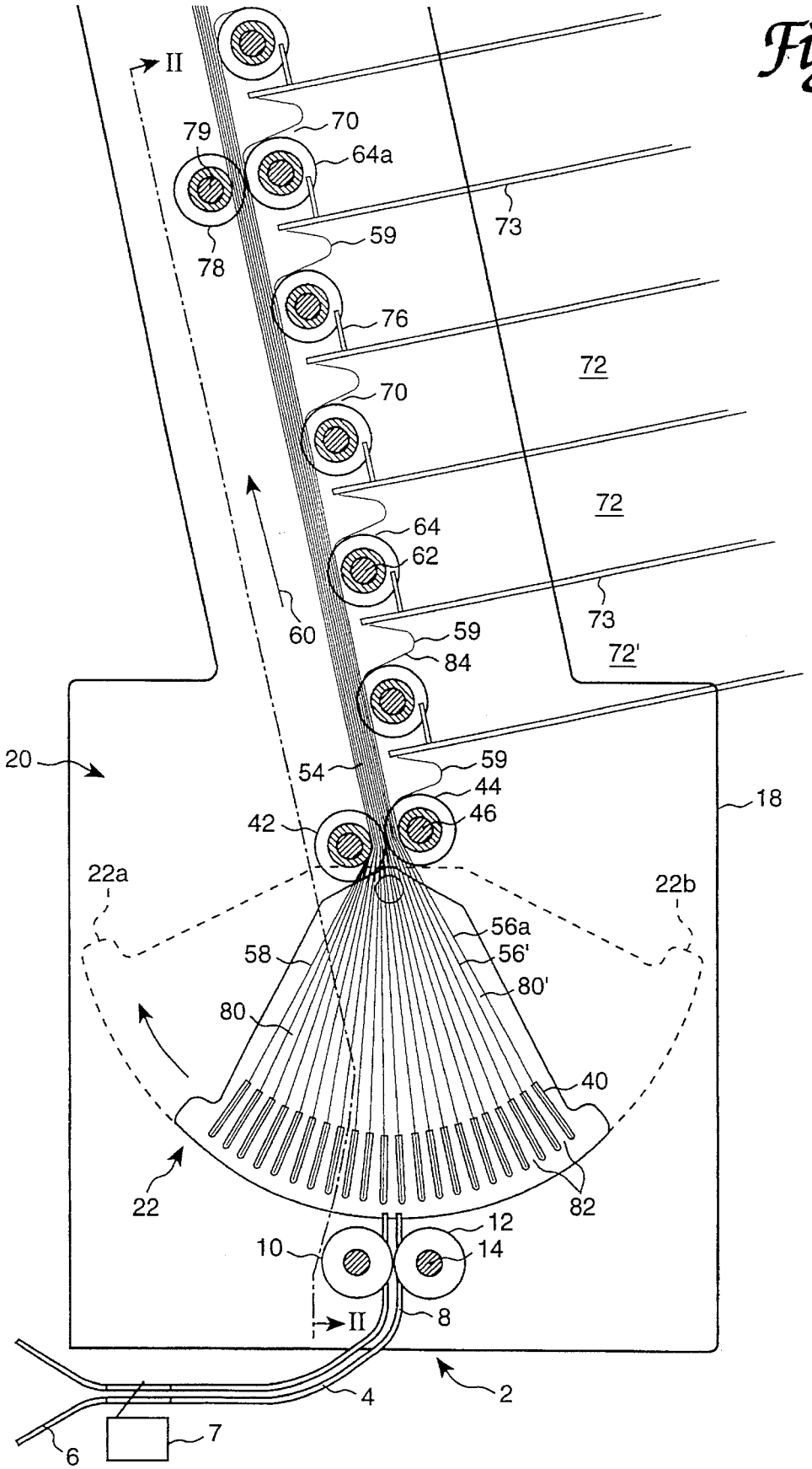
FIG. 1 shows the sorting unit according to the first embodiment in vertical section.

Above the clamping rollers 42, 44, the bands 56 generally run parallel to one another, inclined with respect to the vertical, in a direction denoted by 60, to be precise with different lengths. The lengths of the bands above the clamping rollers 42, 44 are made to match delivery points 70, arranged one above the other, or depositing compartments 72 served by said delivery points. The latter extend approximately at right angles to the path direction 60, i.e. in a slightly upwardly inclined alignment parallel to one another, away toward the right-hand side in FIG. 1. Each delivery point 70 is assigned a transporting roller 64, which is arranged rotationally rigidly on a shaft 62 and, with respect to the bands 56, is provided on the side of the depositing compartments 72. The profile shape of the transporting rollers 64 corresponds to that of the clamping rollers 42 and 44, as a result of which bands 56 can likewise run in the grooves 52 of said rollers and are guided by them. A band **56*a* ends directly underneath the lowermost depositing compartment 72' and forms a delimitation, which is discussed in more detail further below. Each of the bands 56 has a V-shaped end 59, which engages over the transporting roller 64 of the associated delivery point 70 and adjoins a compartment plate 73 of the upwardly next-following depositing compartment 72. Each depositing compartment 72 has side delimitations 74, connected to its compartment plate 73, and also at least one sheet stop 76**.

All the shafts 62 are driven clockwise (FIG. 1) by an electric motor 66 via a power-transmission chain 68, symbolized by intermeshing gear wheels. The driving of the shafts 46 and 14, and of the clamping rollers 44 and 12, also takes place, likewise clockwise, by means of the power-transmission chain 68.

A further point to be made is that at a distance from the pair of clamping rollers 42, 44 which corresponds approximately to that with respect to the clamping rollers 10, 12 there is arranged a counter-roller 78. The counter-roller 78 is in this case assigned to a transporting roller **64*a* at a corresponding distance, in order to interact with the latter in a clamping roller-like manner. A shaft 79 carrying the counter-roller 78 is mounted freely rotatably in the sideplates 18. A sheet B (FIG. 2), to be transported over a greater distance than the abovementioned distance, is seized by the (next) counter-roller 78 before said sheet is released by the clamping rollers 42, 44. The counter-roller 78 has the same profile shape as the clamping rollers 42 and 44, the bands 56, extending over this distance, running through their groove 52. The depth of all the grooves 52 is preferably the same and is somewhat greater than the thickness of the group of bands 54**.

It should further be noted that all the bands or groups of bands are grounded via electrical conductors (not shown). Instead of this, the electrical grounding may take place via suitable electrically conductive members of the distributing device itself, in contact with these bands. For example, the preferably metallic profile elements 40 are very well suited for this. These may be connected electrically conductively to the swivel plates 30, which themselves may be conductive, at least on their surfaces.

Together with the spread lower end parts 58 of the bands 56, the profile elements 40 define receiving compartments 82 which are open toward the sheet duct 4. These receiving compartments 82 form parts of transporting paths 80, formed by in each case two directly neighboring bands 56 of a group of bands 54. Each of the transporting paths 80 leads continuously from one receiving compartment 82 to a predetermined delivery point 70. In this arrangement, all the transporting paths 80 share the transporting members formed by the clamping rollers 42, 44 and also by transporting rollers 64 and, if appropriate, the counter-rollers 78, as long as the respective transporting path extends parallel to the others. On its part facing the transporting roller 64, the V-shaped end 59 of each band 56 forms a deflecting member 84, which belongs to the associated transporting path 80 and leads to the delivery point 70 or into the corresponding depositing compartment 72. The band **56 *a*, which acts as a delimitation and does not itself lead into a depositing compartment, defines together with the directly neighboring bands 56', the transporting path 80' to the depositing compartment 72'**.

It goes without saying that the transporting paths 80 have a width which corresponds at least to the transverse extent, i.e. width of the sheets B to be transported, but is less than the distance of the side-plates 18 from each other. Distributed over this width, a plurality of groups of bands 54, parallel to one another, are involved in the formation of the transporting paths 80. Equally, the latter are assigned a plurality of pairs of clamping rollers 42, 44, distributed over the width, and also transporting rollers 64, which form side guides for the loosely held bands 56 of the groups of bands 54. There are also expendiently a plurality of clamping rollers 10 and 12 arranged in a distributed manner on the shafts 14.

Figure 4:
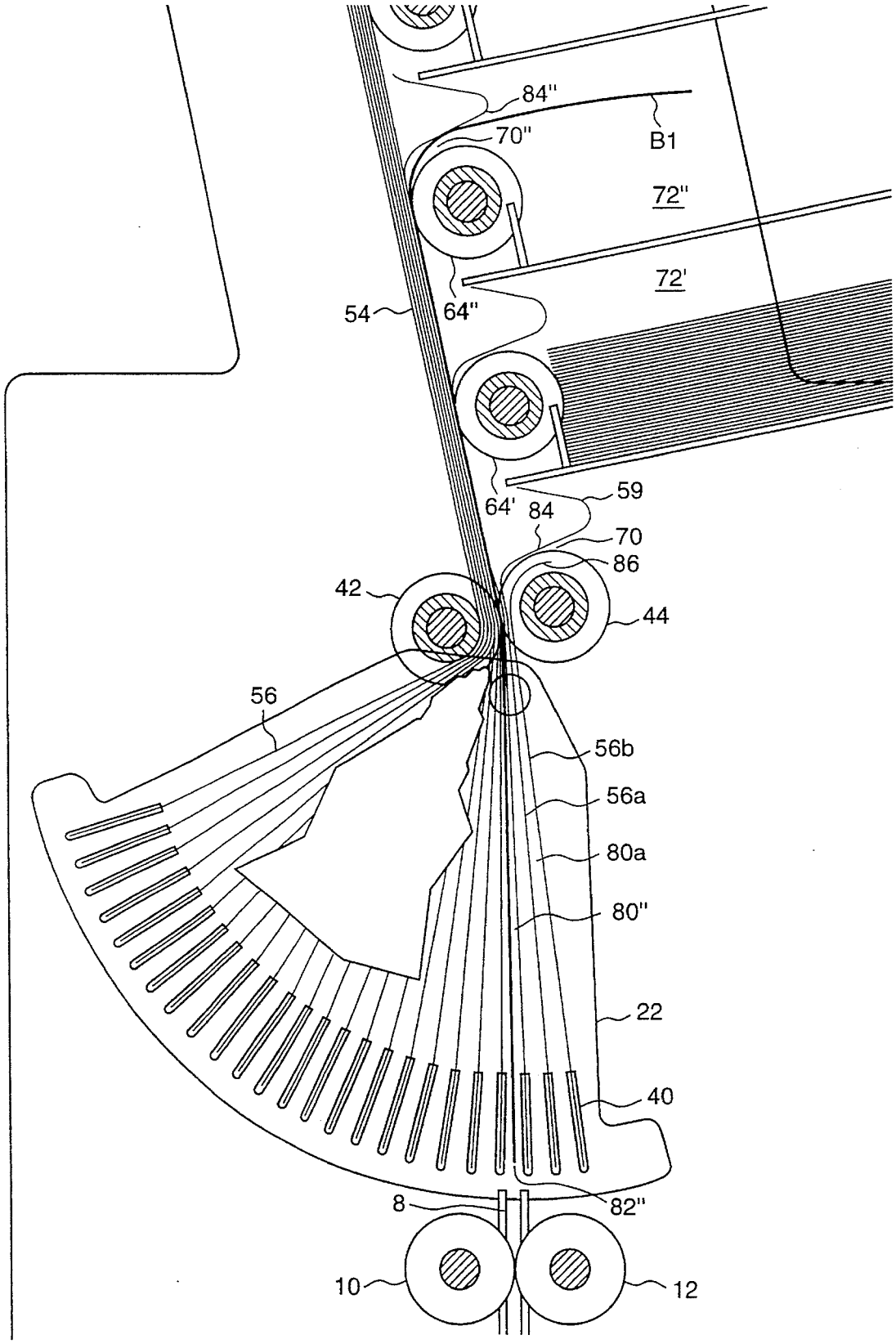
FIG. 4 shows a cutout from FIG. 1, represented on an enlarged scale.

In operation of the sorting unit, arranged for example at the paper delivery of a printer, the passage of the front edge of a first sheet still moved by this printer is established by the sensor 7 in the sheet duct 4 and the electric motor 66 is put into operation. Since the depositing address of each sheet is already determined before this instant, the motor 32 has received a corresponding signal from the printer. In an assumed case, the address A2 has been established by the printer for this first sheet. To this address there corresponds the receiving compartment 82" (FIG. 4). The swivelling unit 22 has accordingly been imparted a swivelling movement into a position such that the receiving compartment 82" lies opposite the outlet end 8 of the sheet duct 4 at the latest when the front edge of the corresponding sheet arrives there.

The sheet seized between the rotating clamping rollers 10, 12 is introduced into the awaiting receiving compartment 82". Further transport takes place subsequently by these clamping rollers 10, 12 alone, when the sheet has been released by the sheet transport on the printer side. On account of the abovementioned distance of the clamping rollers 42, 44 from the clamping rollers 10, 12, the sheet is therefore seized at its front edge by the former rollers before release by the latter rollers. Upon entry of the sheet between the clamping rollers 42, 44, the path 80" corresponding to the address A2 aligns itself locally with the clamping nip 48 (FIG. 3) between these rollers. This path alignment is possible by transverse displacement under resilient flexure of respectively corresponding bands 56, i.e. radially with respect to the clamping rollers 42, 44. On account of its stiffness, the sheet running up against one of the two clamping rollers effects the displacement of the bands running on the remote side into the groove 52 of the other clamping roller. The clamping rollers 42, 44 subsequently transport the sheet then seized by the clamping nip 48 to the depositing compartment 72" (FIG. 4), which is served by the delivery point 70" of the chosen address A2. The frictional force of the transporting rollers 64 respectively reached along the path 80 is involved in this transport. The sheet normally likewise runs against these transporting rollers and aligns the path 80 gradually at a tangent to their circumference. In the assumed case, the transporting rollers 64' and 64" become effective. The respectively last transporting roller 64, that is here the transporting roller 64", ensures that, upon running onto the deflecting member 84" the sheet B1 is introduced with corresponding curvature to the delivery point 70" and from there into the depositing compartment 72". As can be seen from the representation of FIG. 4, the deflecting member 84" has resiliently yielded under the assumed stiffness of the sheet. In the case of still greater stiffness, the V-shaped end 59 may come to bear against the group of bands 54 if the deflection is to come about by curvature of the article, i.e. of the sheet. In the depositing compartment 72", the sheet does not come to a standstill until after it has passed over the transporting roller 64" with its full length. It is then located completely in the depositing compartment and has arrived behind the sheet stop 76. Depending on the transporting speed, it may be expedient to provide at the opposite end (not shown) of the depositing compartments 72 a further sheet stop, which delimits the route of the sheets in the compartments.

In the meantime, the sensor 7 (FIG. 1) has established the passage of the rear edge of the sheet. Likewise, a delay time has elapsed, which with the set transporting speed has resulted in the sheet duct 4 being left completely. It was therefore possible to release the activation of the electric motor 32, in order to provide by means of the swivelling of the swivelling unit 22 that receiving compartment 82 which corresponds to the address of the next-following sheet. The drawing-off of the preceding sheet, here the sheet B1, out of its receiving compartment 82" can take place during the movement of the swivelling unit and is not hindered as a result of this. The resilient bending away of individual bands in the region of the clamping rollers 42, 44 changes according to the swivelling movement of the swivelling unit 22.

The front edges of new sheets follow the rear edges of preceding sheets in a cycle, or time interval, predetermined by the printer. The transporting speed of all the members driven by the electric motor 66 normally corresponds to the conveying speed of the sheet transport on the printer side. If, with a predetermined transporting speed, the abovementioned time interval is not adequate in order to carry out the preparation of the receiving compartment of the address of the next-following sheet in time after release of a sheet by the sheet duct 4, the transporting speed can be periodically increased. This becomes effective by increasing the rotational speed of the electric motor 66 directly at an instant at which the sensor 7 has supplied a corresponding signal on account of passage of the rear sheet edge. On account of the increased transporting speed of all the members, and consequently of the clamping rollers 10, 12, a sheet is then conveyed in shorter time through the sheet duct 4 and subsequently into the prepared receiving compartment 82. In the latter, the conveyance takes place at increased speed until its rear edge has also passed the clamping rollers 10, 12. From now on, the transporting speed is again reduced to the conveying speed of the sheet transport on the printer side, in order to allow the clamping rollers to take over the newly arriving sheet at this speed.

Since the operation is governed by the passage of the rear sheet edge at the sensor 7 in order to raise the transporting speed, it becomes independent of a predetermined sheet length and sheets of different lengths can be processed at a changing transporting speed even without a corresponding printer signal.

In any case, the transport and the depositing of the sheets in the depositing compartments also takes place with great reliability because an electrostatic charging of said sheets has been largely suppressed by the grounded, electrically conductive bands themselves. In the exemplary embodiment shown, twenty receiving compartments 82 are provided, from which the recording media are transported over the same number of separate paths 80 into corresponding depositing compartments 72.

It can be seen from FIG. 4 that a band **56*b* forms the outermost band on the right-hand side of the group of bands 54 and ends in a curved part 86, which directly neighbors the clamping roller 44. The neighboring band 56*a* delimits together with the band 56*b* a path 80*a*, which although it does not lead to a conveying compartment, permits the trouble free exit of a sheet from the sorting unit via the corresponding delivery point 70. The band 56***a*, which is equipped with the V-shaped end 59, leads the sheet by means of its deflecting member 84, with interaction of the clamping roller 44, underneath the depositing compartment 72" to the side. Here, in addition to its normal function, the clamping roller 44 also takes over the function of one of the transporting rollers 64 in the deflection of a sheet.

Figure 6:
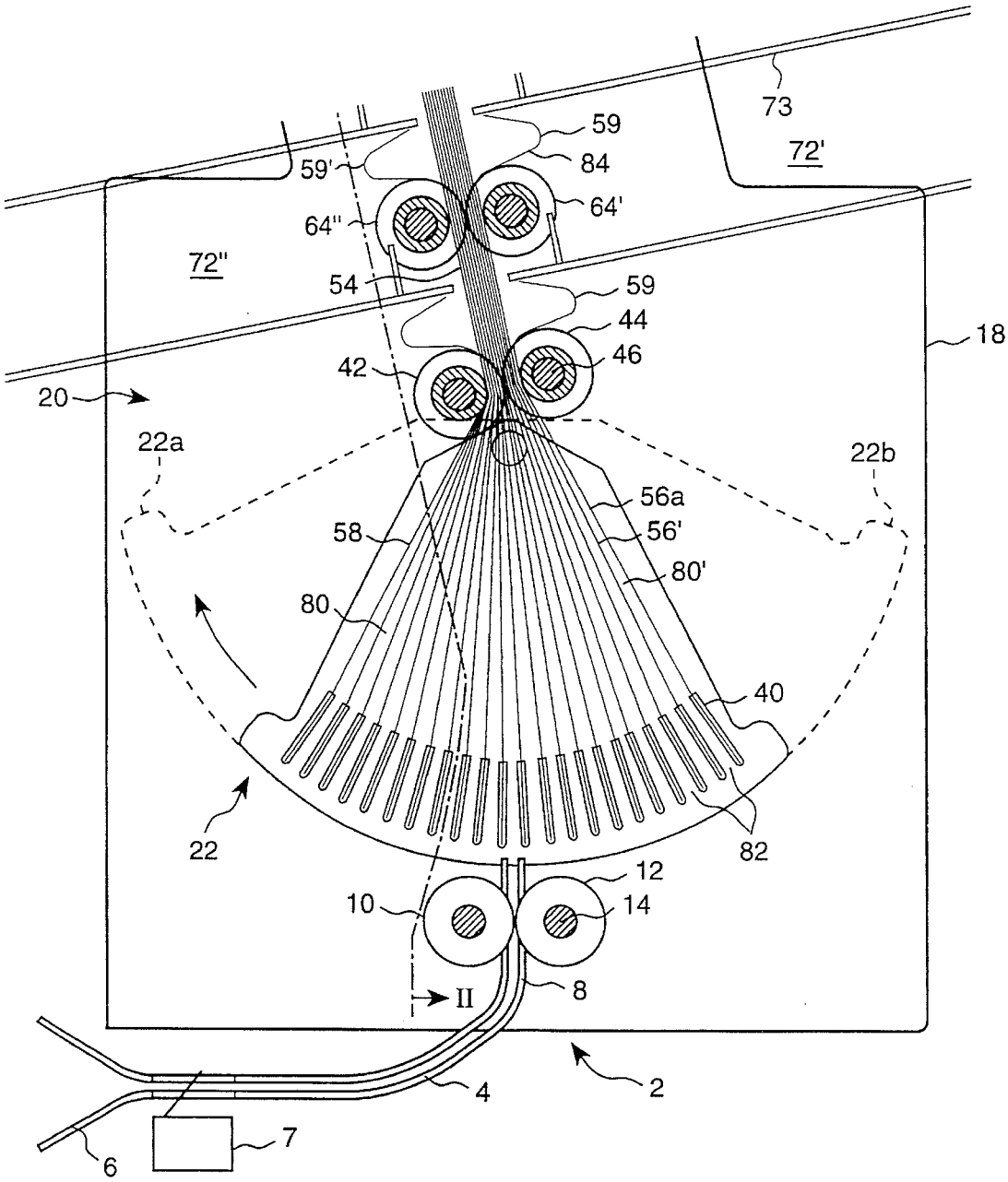
FIG. 6 shows another embodiment of the sorting unit in vertical section wherein delivery points lie on both sides of the transporting paths.

Whereas in the exemplary embodiment described in conjunction with FIGS. 1–4 the delivery points 70 or the depositing compartments 72 are arranged only on one side of the transporting route, or its paths individualized according to the invention, a distributing device according to the invention can be configured with delivery points arranged on both sides of the transporting route. In this case as shown in FIG. 6, between the directing members which, starting from the receiving compartments, lead with lateral alignment to the most remote delivery points, there may be provided a path which likewise begins in a receiving compartment but the delivery point of which is not aligned toward one of the sides but directly in the direction of the path.

Figure 5:
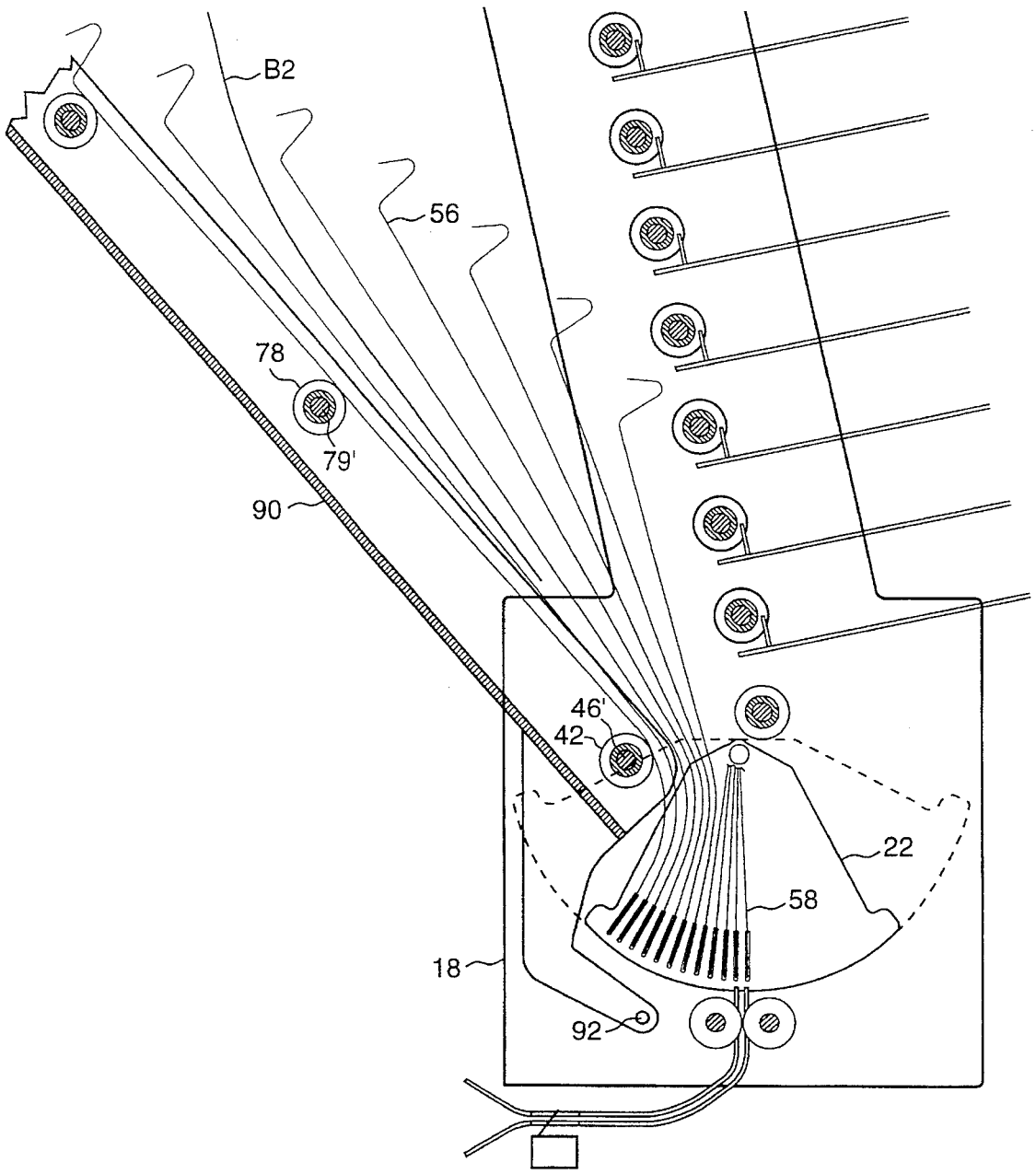
FIG. 5 shows a design variant of the sorting unit according to FIGS. 1–4, represented in the open state.

As revealed by the diagrammatic representation of the exemplary embodiment according to FIG. 5, this differs from that according to FIGS. 1–4 in that here the mounting of the shaft 46' of the clamping roller 42 and of the shafts 79' of the counter-rollers 78 takes place in a cover part 90. The cover part 90 is connected to the sideplates 18 such that it can be swung up about a hinge lying at 92 and, in the swung-down position, can be locked by a closure (not shown).

In the swung-up position of the cover part 90, the clamping roller 42 is lifted-off from the clamping roller 44 and the bands 56 are consequently relieved, at least partially, of the spring pre-tension, which is normally present in the end parts 58 due to their spreading. On the contrary, a spreading of part of the bands comes about. A sheet B2 which has jammed in one of the paths 80 can consequently be removed from the sorting unit manually in the normal transporting direction. In this case, when pulling out, no fixed internals or obstacles have to be overcome and bands which are in the way can be raised for further opening of the paths.

The bands 56, respectively leading to a delivery point 70, represent a shared directing member. Each of the directing members can consequently be formed by in each case a sheet-like member in which clearances are provided for the clamping or transporting rollers and counter-rollers. Instead of a plurality of counter-rollers following one another in the transporting direction, their function can be taken over in principle by a closed belt mounted in a circulating manner. In this case it may be expedient to provide a drive for such a belt, for example from the electric motor 66. In certain applications of a sorting unit, with a driven belt it is ultimately possible to dispense with the driving of the transporting rollers; these then have the function of counter-rollers and are kept in rotation even upon the deflection of a sheet into a depositing compartment by frictional entrainment via the sheet.

If it is intended that articles which have different thickness and/or are stiff can be handled by the sorting apparatus according to the invention, not only the compliance of the directing members is provided but also the mobility or compliance of the transporting members transversely to the transporting direction. For such applications it is particularly advantageous to mount the shafts of the transporting members, and in particular of the counter-rollers, such that they call be displaced or swivelled in parallel in the transverse direction and permit yielding of the same against an approximately constant restoring force. In the case of stiff articles, the distances of the delivery points from one another in the transporting direction are governed by the longest articles to be transported in this direction. In such a configuration the sorting apparatus is capable of sorting not only stiff articles but also articles which are flexible in their surface area.

In principle, the sorting apparatus according to the invention does not require the mobility of the receiving compartments themselves. The necessary relative movement between these receiving compartments as a member of the distributing device and the feeding device can take place by the movable arrangement of the latter or of a part of the same. Thus, the feeding device allows for other designs. If in this case a sheet duct is provided, this may be arranged such that it can swivel, for example about an axis lying at its entry end. Alternatively, for the transport of flexible articles, a duct corresponding to the sheet duct may be configured in a flexible manner, for example, formed by a pair of directing members, which may make it possible for its entry end to be kept stationary, i.e. with an immovable direction of entry.

Figure 7:
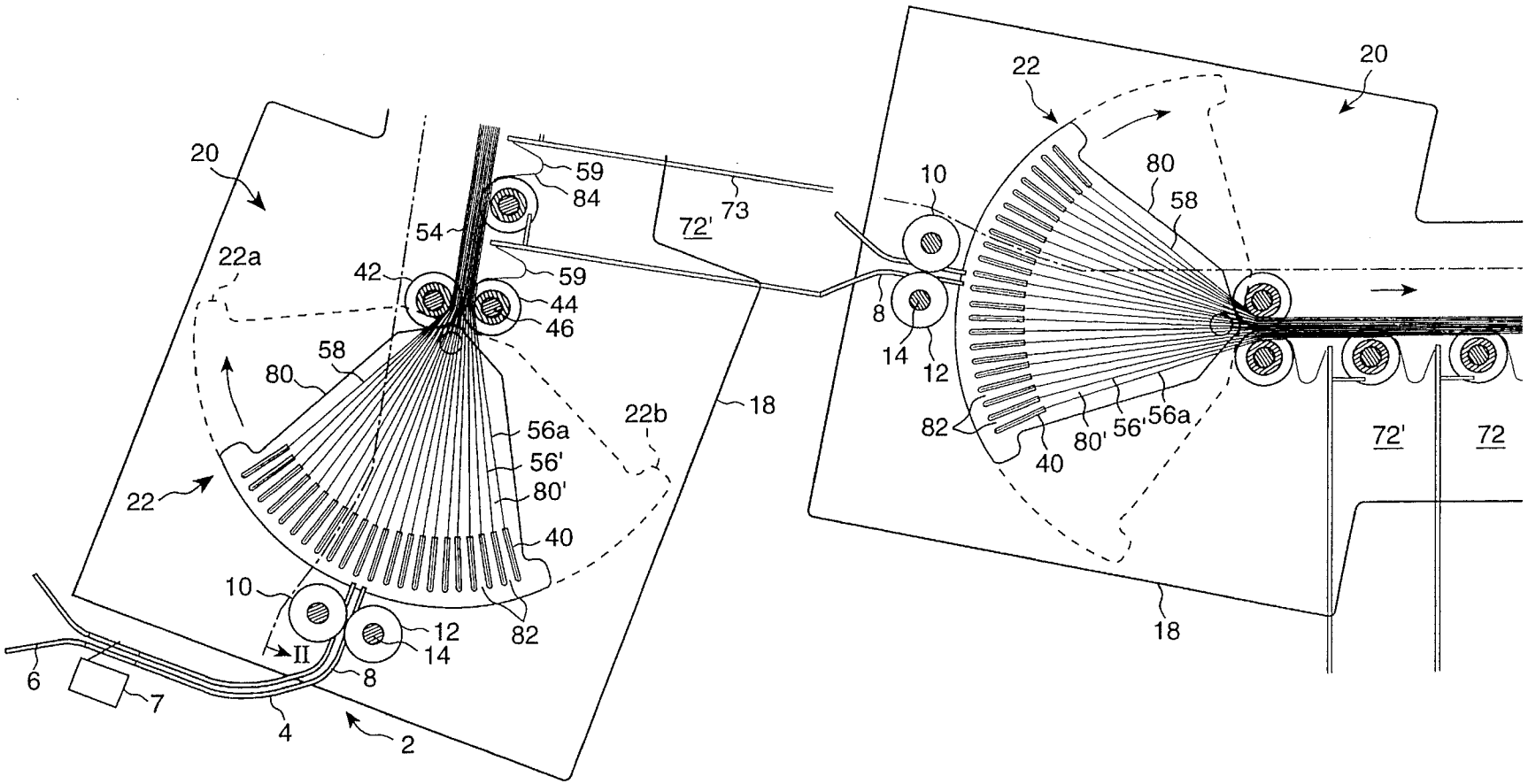
FIG. 7 shows yet another sorting unit wherein the delivery points form the feeding devices of a following distributing device.

It should be made clear that the sorting apparatus according to the invention can comprise a multiplication of the paths and delivery points, achieved by multistage design. Each delivery point of the stage preceding in the transporting direction forms the feeding device of the next-following stage as shown in FIG. 7. The individual delivery point is then followed by the next-following distributing device, present instead of a depositing compartment. In a generally cascade-like arrangement there are then for each path a plurality of pairs of feeding and distributing devices arranged one downstream of the other.

Such sorting apparatuses of a multistage design can be used with advantage in the case of relatively large numbers of sorting addresses, inter alia for increasing the sorting rate. However, in this way it is also possible to overcome the restrictions which limit the number of receiving compartments per stage for design reasons.

An application by way of example for the multistage design may be in the postal sector for the sorting of items of mail according to zip code numbers. The feeding device of at least the first stage may in this case be assigned a reading unit if the determination of the zip code numbers has not already taken place in advance. In such a case, a control device belonging to the sorting apparatus is provided, which device calculates from the zip code numbers determined by the reading unit the sequence of sorting addresses for all the stages, in order to control for example the swivelling movement of the receiving-compartment units.

We claim:

1. A sorting apparatus for sheet-like articles, having a plurality of stationary delivery points, a feeding device and a distributing device following said feeding device on a transportation route to the delivery points, and transporting members associated with the transporting route, the distributing device comprising:

a plurality of directing members which delimit for each delivery point, separate paths of the transporting route, first ends of each of said directing members defining receiving compartments with the number of receiving compartments corresponding to the number of paths, said receiving compartments forming a unit which faces the feeding device and is movable in relation thereto, second ends of each of said directing members defining deflecting members, each of said deflecting members being associated with a particular delivery point, and an actuating member for producing the relative movement between the feeding device and unit and wherein directing members and transporting members are movably guided in relation to one another transversely to a path direction and the transporting members are shared by all of the paths.

2. The sorting apparatus as claimed in claim 1, wherein, for the delimitation of in each case two neighboring paths, there are provided a plurality of parallel running directing members of said plurality of directing members, which are configured in strip form and flexurally elastic, at least one being electrically conductively designed and grounded.

3. The sorting apparatus as claimed in claim 1, wherein the transversely movable directing members are guided laterally by certain of the transporting members.

4. The sorting apparatus as claimed in claim 3, wherein each of the transporting members includes a plurality of jointly driven rollers, which are distributed with respect to the directing members in the width of the transporting paths and are seated on a common shaft.

5. The sorting apparatus as claimed in claim 4, wherein the directing members are guided in grooves of the rollers.

6. The sorting apparatus as claimed in claim 1, wherein the directing members are resilient metal bands.

7. The sorting apparatus as claimed in claim 1, wherein the unit is arranged movably such that it can swivel and the feeding device is arranged such that it is stationary.

8. The sorting apparatus as claimed in claim 1, wherein the delivery points lie on both sides of the transporting paths.

9. The sorting apparatus as claimed in claim 1, wherein the delivery points form the feeding devices of following distributing devices.

10. The sorting apparatus as claimed in claim 1, wherein the transporting members are mounted movably against a restoring force transversely to the transporting direction.

* * * * *